United States Patent [19]

Scheuchzer et al.

[11] 4,347,688

[45] Sep. 7, 1982

[54] RAILROAD RAIL GRINDING TRUCK

[75] Inventors: Fredy Scheuchzer, Lausanne; Fritz Buhler, Ecublens, both of Switzerland

[73] Assignee: Les Fils d'Auguste Scheuchzer S.A., Switzerland

[21] Appl. No.: 157,053

[22] Filed: Jun. 6, 1980

Related U.S. Application Data

[63] Continuation-in-part of Ser. No. 947,067, Sep. 29, 1978, abandoned.

[30] Foreign Application Priority Data

Oct. 10, 1977 [CH] Switzerland ..... 12337/77

[51] Int. Cl.[3] ..... B24B 23/00; B24B 49/10

[52] U.S. Cl. ..... 51/178; 51/165.87

[58] Field of Search ..... 51/139, 165.87, 178

[56] References Cited

U.S. PATENT DOCUMENTS

| | | | |
|---|---|---|---|
| 1,004,276 | 9/1911 | Kerwin | 51/178 |
| 1,405,019 | 1/1922 | Simard | 51/178 |
| 1,543,404 | 6/1925 | Stokes et al. | 51/178 |
| 1,958,709 | 5/1934 | Lanyon | 51/178 |
| 2,018,411 | 10/1935 | Miller | 51/178 |
| 2,324,263 | 7/1943 | Lowe | 51/178 |
| 3,415,017 | 12/1963 | Murray | 51/139 |
| 3,606,705 | 9/1971 | Rivoire | 51/178 |
| 4,091,578 | 5/1978 | Panetti | 51/178 |

FOREIGN PATENT DOCUMENTS

| | | | |
|---|---|---|---|
| 660420 | 5/1938 | Fed. Rep. of Germany | 51/178 |
| 869608 | 1/1953 | Fed. Rep. of Germany | 51/178 |
| 2302384 | 9/1976 | France | 51/178 |

*Primary Examiner*—Harold D. Whitehead
*Assistant Examiner*—K. Bradford Adolphson
*Attorney, Agent, or Firm*—Robert E. Burns; Emmanuel J. Lobato; Bruce L. Adams

[57] ABSTRACT

A rail road rail grinding truck adapted to grind the top surface of the rail comprises at least one grinding unit of which the position is adjustable by means of a cylinder and also of rail-engaging bearing shoes following the undulations of the rail surface. Each unit comprises an adjustable stop member responsive to a servo-action regulation device as a function of the grinding wheel wear and also of the rail undulations, so that the point of contact between the wheel and the rail cannot fall below the grinding base determined by the bearing shoes.

15 Claims, 16 Drawing Figures

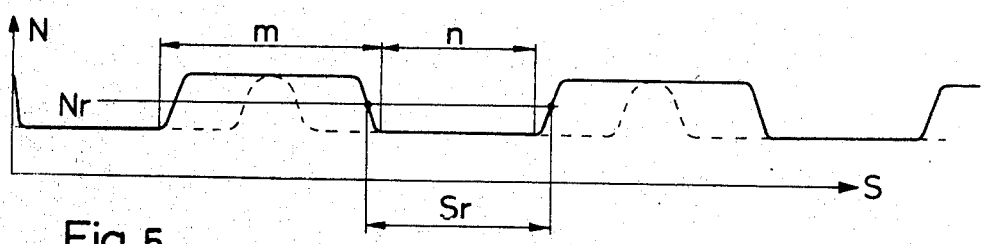
Fig. 5
Fig. 6
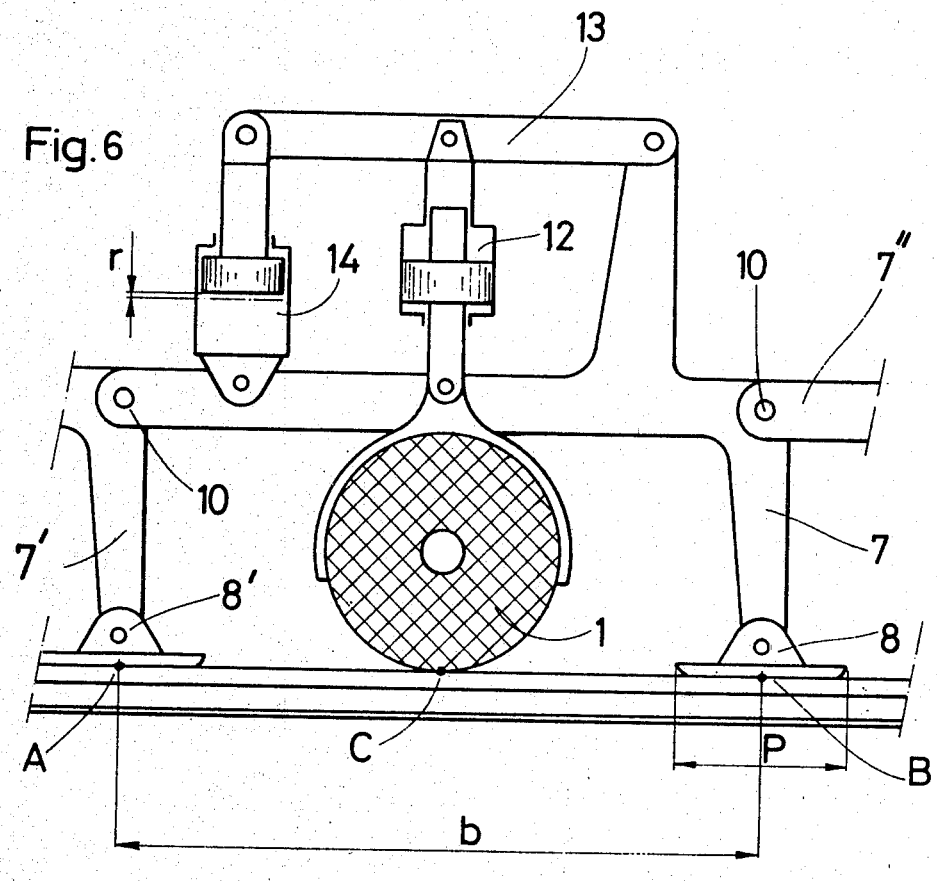

RAILROAD RAIL GRINDING TRUCK

This application is a Continuation-in-Part of Application Ser. No. 947,067, filed Sept. 29, 1978, now abandoned.

FIELD OF THE INVENTION

The present invention relates in general to railroad track machines and has specific reference to a truck for grinding the rail treads, which comprises at least one grinding unit of which the position in relation to the underlying rail is adjusted automatically by means of at least one fluid-operated cylinder and also by means of shoes bearing on the rail.

DESCRIPTION OF THE PRIOR ART

Rail grinders comprising cup wheels, that is, vertical-axis grinding wheels, are already known; in these devices, the grinding wheels bear with a constant force against the rail surface. In machines of this type, the workhead is guided in the vertical plane and suspended by means of hydro-pneumatic cylinders.

However, these known devices are objectionable since they tend to copy the rail undulation as shown in FIG. 1, when the undulation length L is longer than the diameter d of the grinding wheel 1 that follows the undulation; the trough is not ground along the length n; the effective grinding length is indicated by m.

In actual practice this undulation copying is enhanced by the fact that the wheel 1 is not perfectly horizontal but set at an angle $\beta$.

When this angle $\beta$ exceeds the angle $\alpha$ of the undulation, the grinder follows the undulations throughout their length L.

Another known device, quite similar to the preceding one and illustrated in FIG. 2, comprises several grinding wheels 1 rigidly mounted in a wheel support. At least two wheels of the carrier bear with a constant force against the rail to be ground. This arrangement is advantageous in that the grinding base b of the group of wheels 1 is longer than in the first prior art device mentioned hereinabove, so that only undulations having a length L greater than or equal to the length of the grinding base b are copied.

Another well-known device (Swiss Pat. No. 500335) is shown in FIG. 3 and comprises a grinding wheel 1 having a horizontal axis and connected by means of a hydraulic cylinder 12 to a guide frame 7 bearing on the rail through shoes or skids 8 and 8'. The downward speed Vh of the wheel 1 that moves in the horizontal direction with the traveling speed V, is controlled by the hydraulic cylinder 12 and is so adjusted that the wheel 1 is caused to "jump" from the vertex M of one wave crest to the side face of the next wave crest, as indicated in broken lines. The other reference signs have the same meaning as in FIG. 2.

To attain the ideal grinding conditions, the downward speed Vh of the wheel 1 should be variable as a function of the length L and depth of the undulations and also of the speed V of the grinding truck along the track. Now this requirement is obviously not met by the known devices and it is observed that when the downward speed Vh is too high, the undulations are copied. On the other hand, if this speed Vh is too low, only the vertices of the undulations are ground.

To sum up, all known devices proposed up to now for grinding railroad rails are defective in that after their passage a certain degree of undulation is still present.

SUMMARY OF THE INVENTION

The various shortcomings set forth in the foregoing are avoided by the present invention which provides a railroad rail grinding truck wherein the grinding unit comprises an adjustable stop means controlled by a regulation and control device responsive both to the degree of wear of the grinding wheel or wheels and to the undulation dimensions, so that the point of contact of the wheels cannot move downwards beyond the grinding these determined by the shoes.

The basic principle of the present invention and various possible forms of embodiment thereof will now be described with reference to the attached drawings.

BRIEF DESCRIPTION OF THE DRAWINGS

FIG. 5 is a diagram showing the power consumption of the grinding motor as a function of the covered distance;

FIG. 6 shows the arrangement of the grinding wheel and its stop means in an enlarged scale;

DESCRIPTION OF THE PREFERRED EMBODIMENTS

Figure 4:
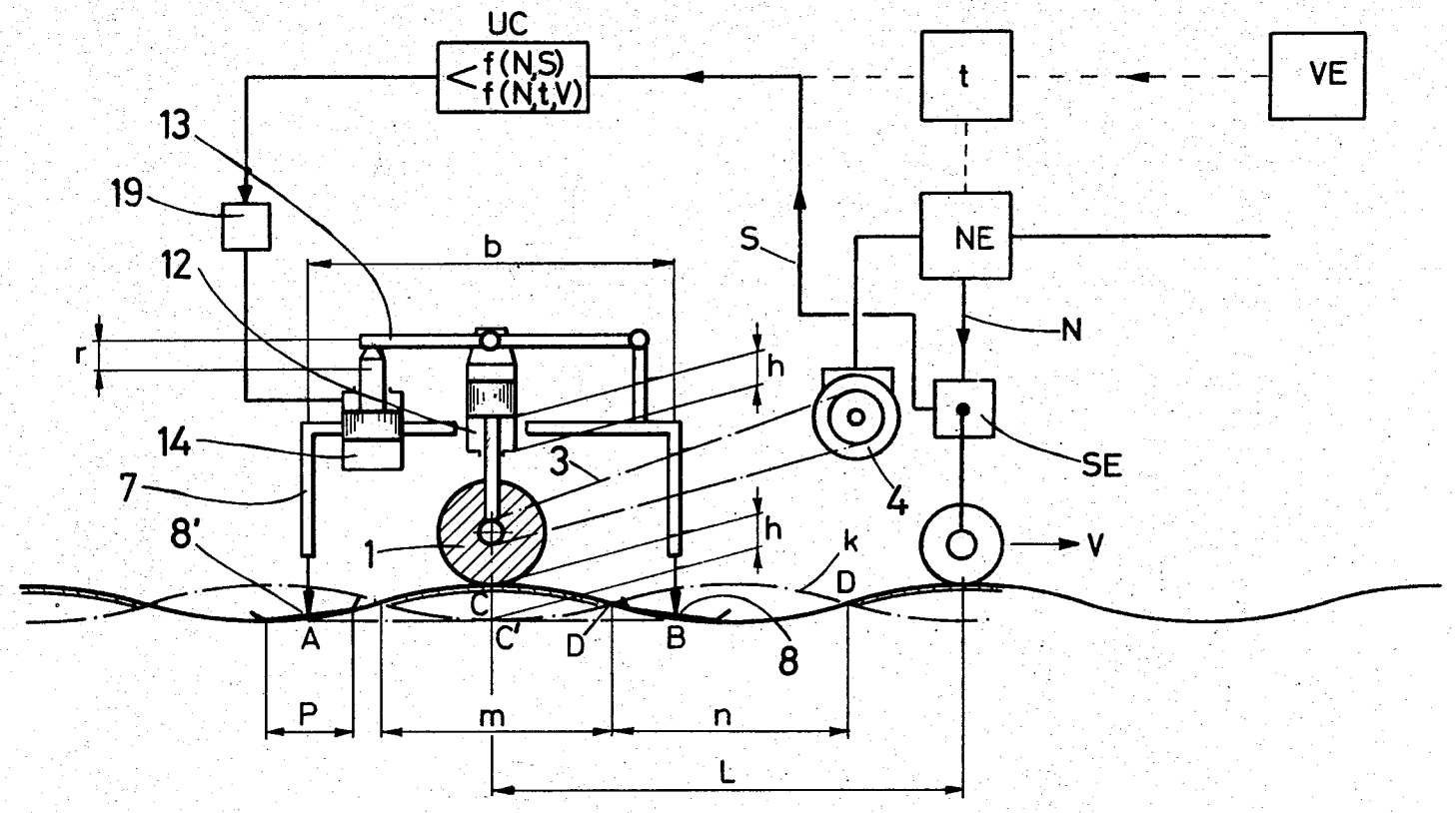
FIG. 4 illustrates schematically a first embodiment and the basic principle of the present invention.

Referring first to FIG. 4, which illustrates the basic principle of the present invention. The grinding unit or workhead comprises a rotary grinding wheel 1 carried by a hydraulic cylinder 12 which is articulated to a rocker 13. This rocker 13 is connected to the guide frame 7 that can be moved down from the truck chassis not shown in FIG. 4 but illustrated in FIG. 15 with the reference 38. The guide frame 7 is equipped with bearing shoes 8 and 8' having the length P and resting on the rails. The one end of the rocker 13 is directly articulated to the guide frame 7, while the other end is supported on or articulated to a stop means 14 that can be adjusted relative to the guide frame 7. According to the first embodiment shown in FIGS. 4, 6 and 7 this stop means 14 consists of a hydraulic cylinder fixed or articulated to the guide frame 7 and having a piston connected to the rocker 13.

The grinding wheel is driven by a motor 4 by means of a belt transmission 3 (FIG. 4). The power consumption N of the motor 4 is measured by a measuring device NE. The distance S travelled along the track is measured by means of a wheel that rolls on the rail and by means of a measuring device SE. This distance S can also be derived from the measurement of the speed V measured by means of a tachometer VE and from the measurement of the time t as indicated in FIG. 4 with dotted lines.

The measured quantities N and S or N,t and V are transmitted to a control device or servo-action regulation device UC which adjusts the stop means 14 via a control valve 19 as a function of the power consumption N and of the directly or indirectly measured distance S covered on the track. This adjustment takes place automatically in such a way that the point of contact C between the grinding wheel 1 and the rail cannot fall below the point C′ being on a straight line connecting the points of contact A and B of the bearing shoes 8′ and 8 with the rail. This straight line defines a grinding base or a reference plane. The point C′ follows the undulation according to a curve k that is shifted relative to the undulations of the track as indicated by a dot-dash line in FIG. 4. The position of the crossing points D between this curve k and the undulation of the track varies in dependence on the ratio of the length b of the grinding base, that is the distance between the points A and B, and of the length L of the undulation. These crossing points D determine the lengths m and n which are ground and not ground respectively.

FIG. 5 shows the power consumption N of the grinding motor 4 as a function of the distance S covered on the track, whereby the length m is ground and the length n is not ground. The power consumption N varies of course during the grinding of the undulations and attains a maximum value when the grinding wheel 1 is on a peak and drops to the no-load value when clearing a trough. The trace of the curve of N as indicated in FIG. 5 changes in course of time as a function of the grinding wheel wear. The curve of N shown in unbroken line in FIG. 5 is characteristic of a new or only slightly worn grinding wheel, while the curve of N shown in dotted line corresponds to a strongly worn grinding wheel. Within a predetermined reference distance Sr the power consumption N is smaller than a given value Nr being a little large than the no-load value and therefore characteristic of a period where no grinding or only a negligible grinding takes place.

The wheel diameter decreases as the wheel material wears out and consequently the working point C (FIG. 4) of the wheel 1 rises in relation to the base A-B, and the grinding length m gradually decreases, while the length n increases. If the measured length n that corresponds practically to the no-load consumption exceeds the reference distance Sr (FIG. 5), then the servo-action regulation device UC (FIG. 4) causes the stop means 14 to move downwards e.g. through a distance r. All the parameters as Nr, Sr and r can be adjusted according to the working conditions.

The automatic adjustment of the stop means 14 as described is based on a measurement of the power consumption N of the grinding motor 4 as a function of the measured distance S travelled.

According to another example of operation the servo-action regulation device UC responsive to the degree of wheel wear can be controlled also by the measurement of the vertical movement h of the grinding wheel as a function of the directly or indirectly measured distance S covered on the track. The course of the vertical movement of the grinding wheel 1 depends naturally not only on the height h of the undulation (FIG. 4) but also on the wheel wear and is characteristic of the effective grinding length. When the wheel wear exceeds the height h of the undulation between points A and B, the grinding length is zero.

Figure 15:
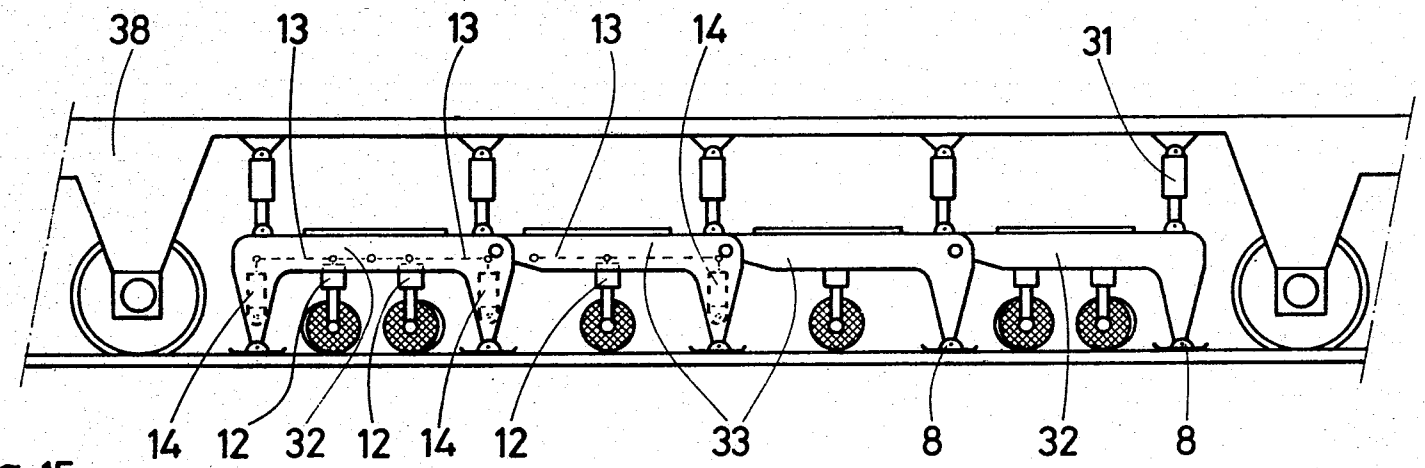
FIG. 15 is an elevational view of a typical grinding truck according to the invention.

FIG. 6 shows the guide frame structure comprising a L-shaped frame 7, on both sides thereof similar frames 7′ and 7″ carrying to the adjacent workheads and interconnected by pivot pins 10, and the bearing shoes 8 and 8′. This frame structure is suspended, as shown in FIG. 15, by means of pneumatic cylinders 31 from the track chassis 38. These pneumatic cylinders relieve the workheads and raise them under light-running conditions. The rocker 13 pivoted on the frame 7 carries the hydraulic control cylinder 12 with the grinding wheel 1. This cylinder 12 is adapted to regulate the bearing force and to limit the wheel stroke. It is operatively connected via the pivoted rocker 13 to the stop means 14 in the form of a hydraulic cylinder, the piston thereof is pivoted on the rocker 13 while the cylinder housing is pivoted on the guide frame 7.

Figure 1:
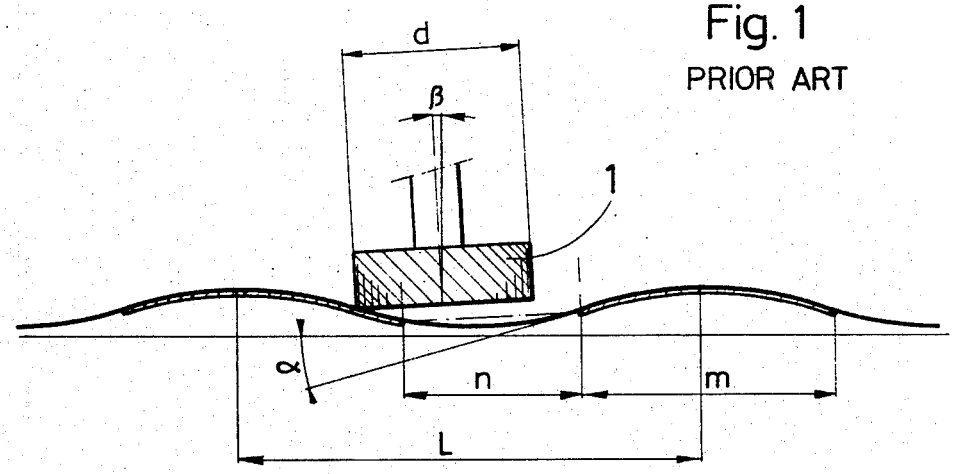
Fig. 1 PRIOR ART
FIGS. 1 to 3 illustrate the present state of the prior art, already explained.
Figure 2:
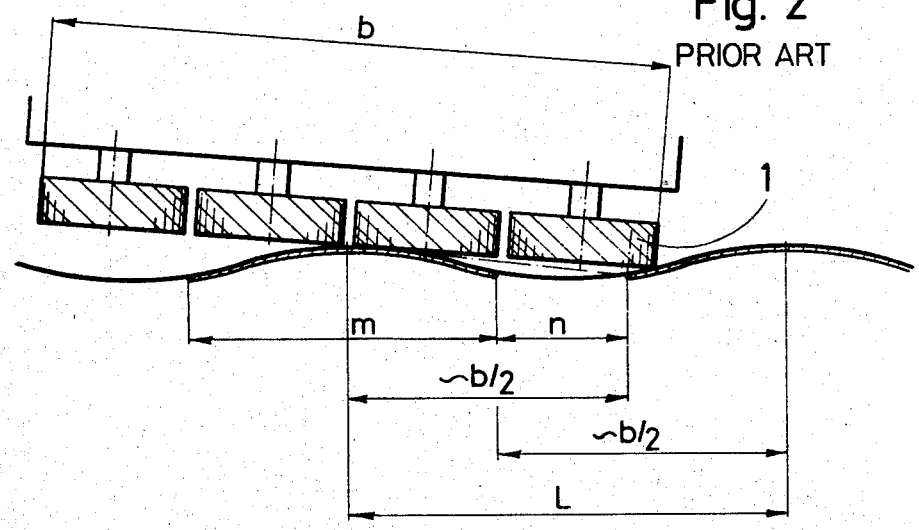
Fig. 2 PRIOR ART
Figure 3:
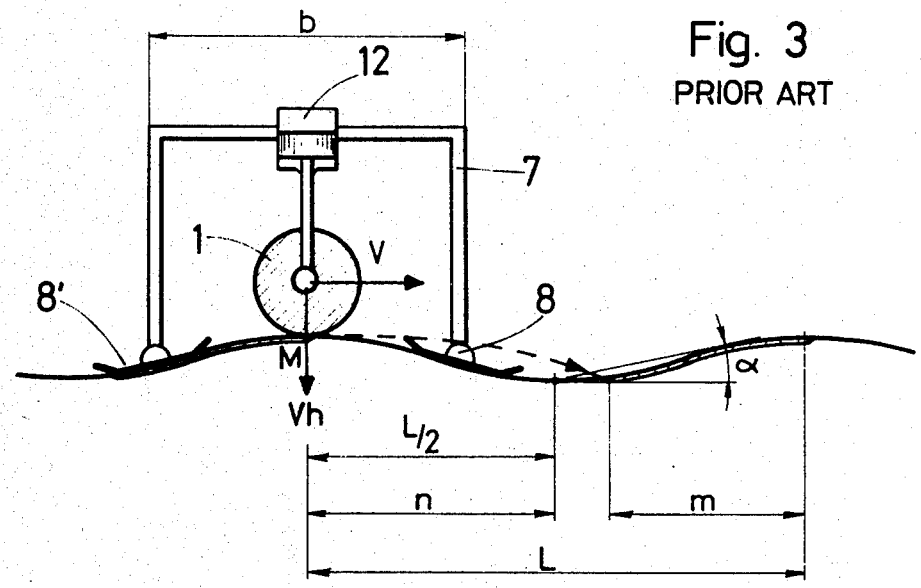
Fig. 3 PRIOR ART
Figure 7:
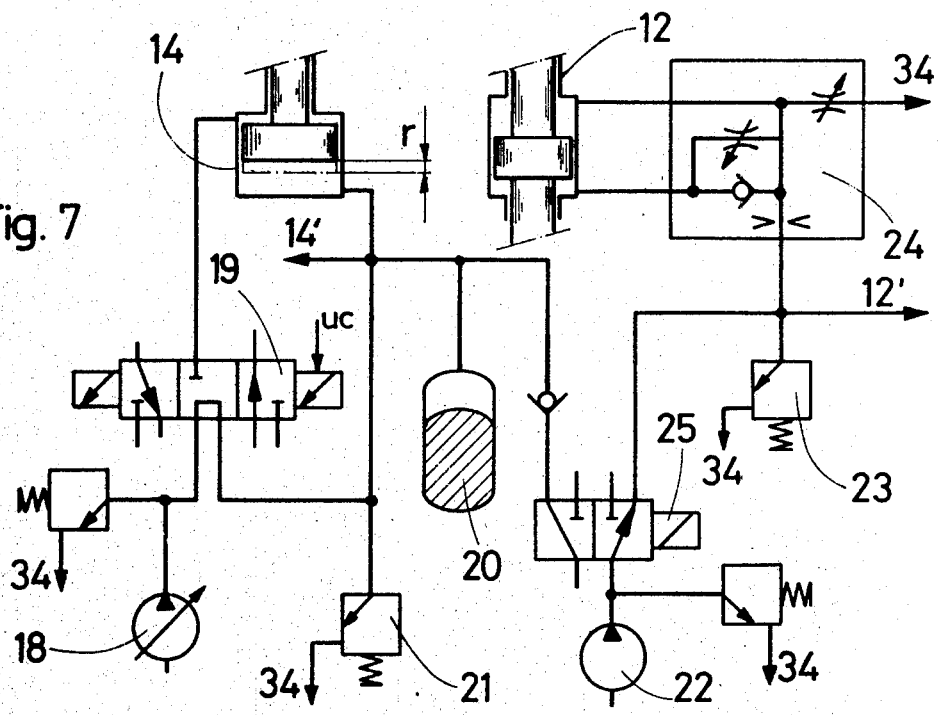
FIG. 7 illustrates a scheme of the hydraulic control device.

The hydraulic diagram of FIG. 7 shows the manner in which the grinding wheel cylinder 12 and the hydraulic cylinder 14 forming the stop means are controlled. The pump 22 supplies hydraulic fluid to several grinding cylinders 12,12′ with a constant pressure adjusted by means of a valve 23. The references 34 denote the return circuits to the hydraulic reservoir. The function of the output and pressure regulator 24 is to adjust the grinding force as well as the rate of downward and upward travel of the grinding wheel. A variable output pump 18 feeds the cylinder of the stop means 14 and the cylinders of further stop means 14′ via a control and distribution valve 19. The piston of stop means 14 is held in position by a counter-pressure created by an accumulator 20 and adjusted by valve 21. The stop means 14 that limits the downward stroke of the grinding wheel is adjusted in such a way that its point C of contact or working (FIG. 6) cannot fall below the base A-B. During the operation the control and distribution valve 19 is controlled by the servo-action device UC to lowering the stop means 14 stepwise through small distances r as a function of the wheel wear in such a way that said point of contact C never falls below the base A-B. The purpose of the solenoid valve 25 is to permit the manual control of stop member 14.

Figure 8:
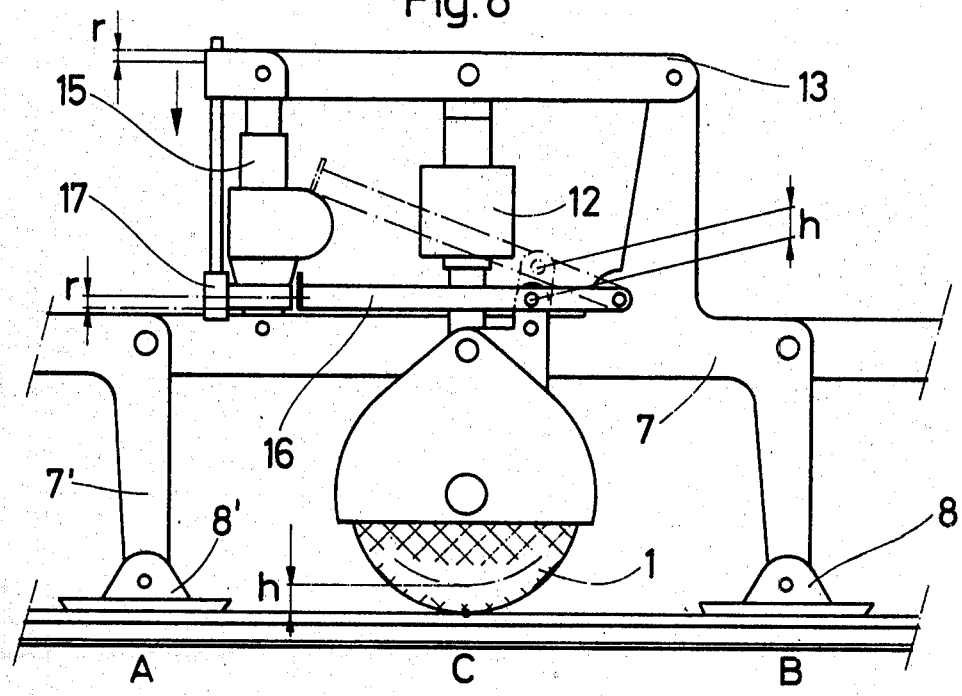
FIG. 8 shows a second embodiment having mechanically adjustable stop means.
Figure 9:
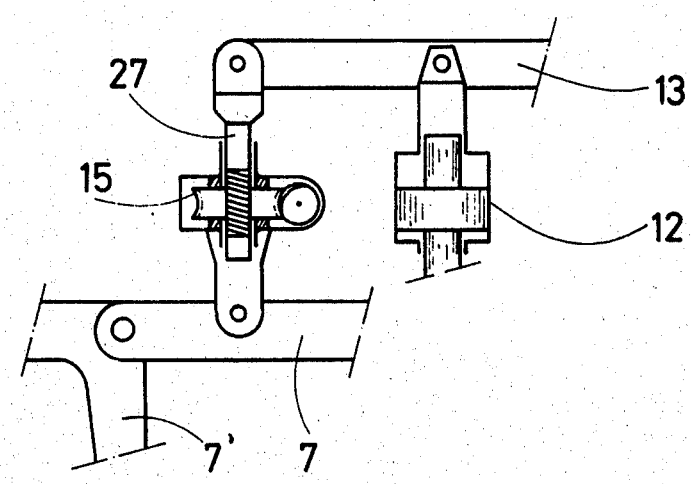
FIG. 9 is a partial section view of the stop means and its adjusting device according to FIG. 8.

The embodiment shown in FIGS. 8 and 9 comprises a mechanically adjusted stop means 15 consisting of a screw 27 whose upper end is pivoted on the rocker 13, and a nut fitted on said screw 27 and driven through a reduction gear from a step by step motor. The reduction gear is composed of a worm wheel formed by said nut and a worm driven by said step by step motor. The casing of the reduction gear is pivoted on the guide frame 7 supported by the bearing shoes 8 and 8′. The rocker 13 is articulated to the frame 7 and carries the hydraulic cylinder 12 with the grinding wheel 1. In this case it is the vertical movement h of the grinding wheel 1 that is measured as a function of the distance travelled in order to control the adjustment of the stop means 15. The vertical movement h is multiplied by a lever 16 movable in relation to a sensor 17 secured to stop means 15. When the contact between the lever 16 and sensor 17 exceeds a predetermined time or distance corresponding to the reference distance Sr (FIG. 5) the regulator causes the stop means to move downwards through a distance r. To this end the servo-action regulating device controls the step by step motor as a function of parameters N and S or N, V and t in order to cause the screw 27 to move downwards through a predetermined distance r. A potentiometer is provided for varying the distance r of the screw 27 with a tolerance of 1/100$^{th}$ of mm., and a manual control permits the fast positioning of stop means 15.

The automatic control of stop means 15 can also be realized by measuring the power consumption N of the grinding motor 4 as described for the first embodiment.

Figure 10:
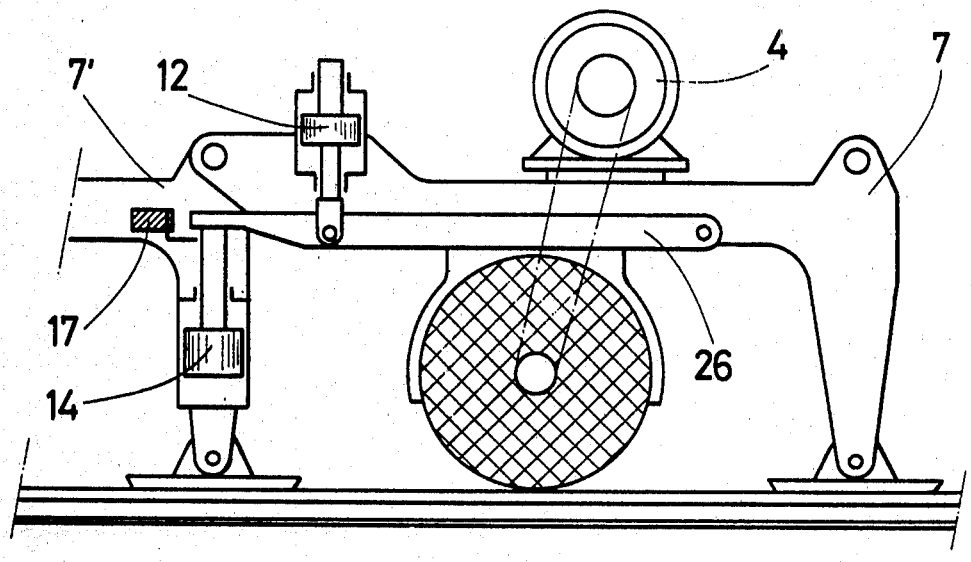
FIGS. 10 to 14 show modified forms of embodiment of the grinding unit.

FIG. 10 illustrates a modified form of embodiment of the grinding unit or workhead with the grinding motor 4, in which this unit is mounted on a suspension arm or rocker 26 also adapted to control the vertical stroke of the wheel, which is compared by a sensor 17 mounted on the hydraulic stop means 14. As shown in FIG. 10, the piston of the hydraulic grinding cylinder 12 is pivoted on the rocker 26 whose one end is pivoted on the guide frame 7 and whose other end is fixed to the piston of the stop means 14, the cylinder housing thereof forms part of the leg of the frame 7'. This stop means 14 may be replaced by a mechanical stop means, if desired.

Figure 11:
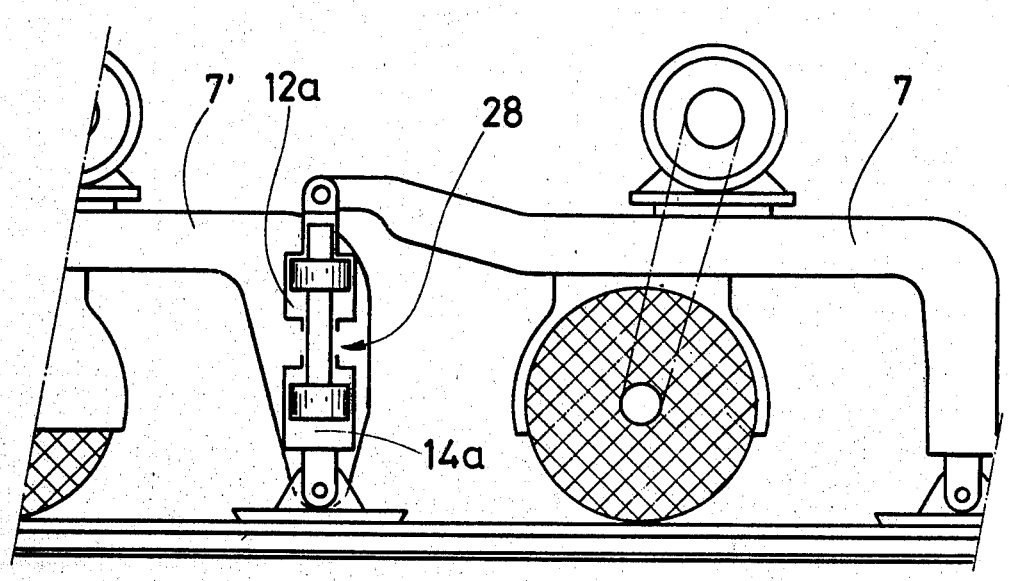

The grinding unit illustrated in FIG. 11 comprises a twin cylinder unit 28 comprising coaxial cylinders **12*a* and 14*a* and a common piston rod for both pistons. The upper cylinder 12*a* operates as a grinding wheel cylinder and the piston in the lower cylinder 14*a*** acts as an adjustable stop means. Of course, these grinding units are equipped with the above-described control and regulation devices.

Figure 12:
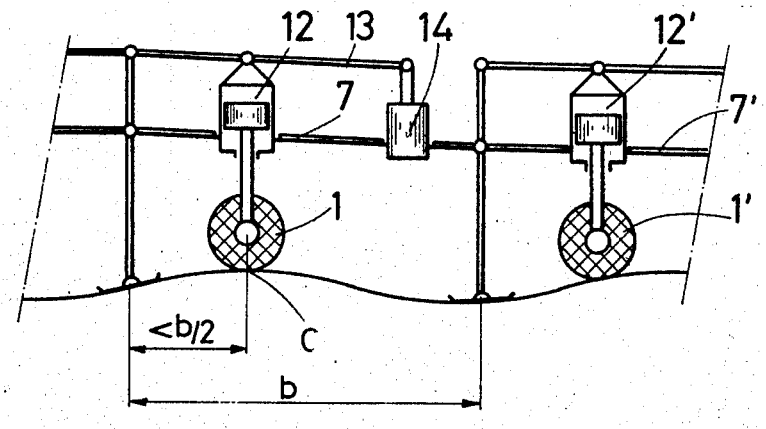
Figure 13:
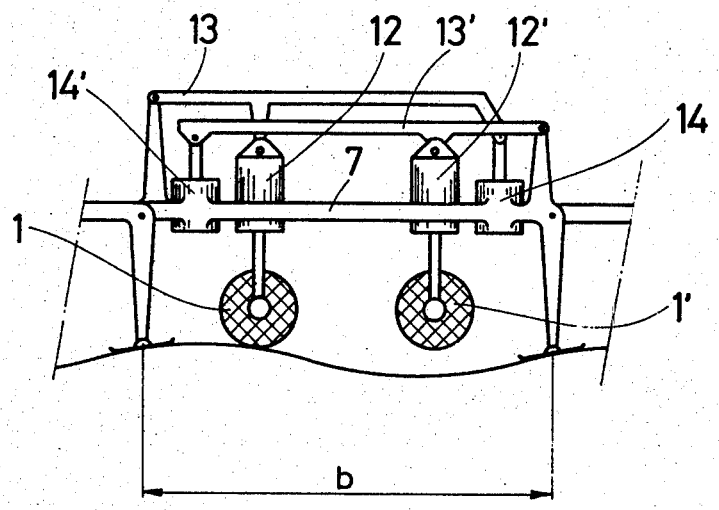
Figure 14:
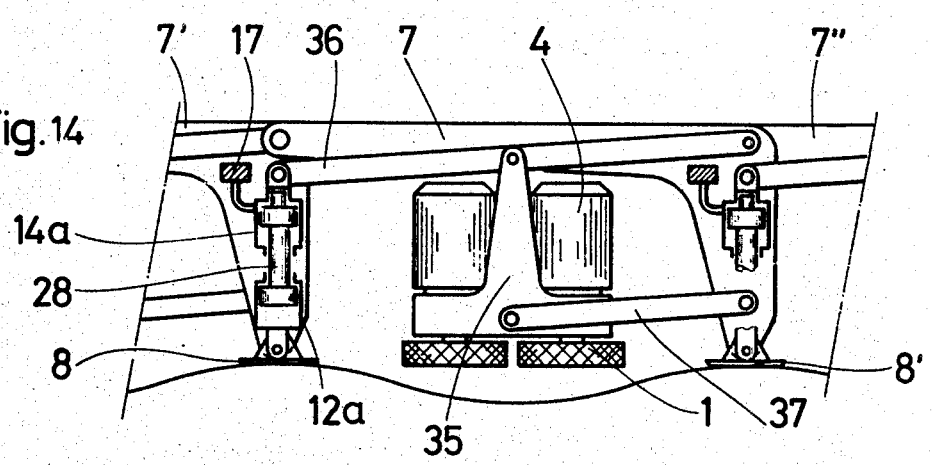

As already mentioned, each grinding device tends to copy undulations of predetermined pitch or length. To avoid this inconvenience, several possibilities are available:

several grinding units or heads having different grinding bases can be mounted on the truck, or the grinding or workhead can be arranged asymmetrically with respect to the grinding base as shown in FIG. 12, or each device can be provided with a plurality of grinding heads as shown in FIGS. 13 and 14. The parts have been denoted with the same references as in the preceding embodiments.

The grinding devices having several grinding wheels can be controlled in dependence on the wear of one single wheel or on the wear of each grinding wheel 1 and 1' by means of several regulators and stop means 14,14' as shown in FIG. 13.

Horizontal-axis wheels grind only the top or tread surface of the rail, but the burrs or beards formed on the inner face of the rail are not removed. To re-shape this rail portion, the wheel axis may be inclined by a certain angle. In this case, the frame must be guided not only in the vertical plane but also in the horizontal plane, and therefore the shoes are provided with lateral guide means and pressed by a cylinder against the side of the rail.

All the grinding units described hereinabove may be equipped with workheads having vertical-axis wheels, or the so-called cup wheels, controlled and driven in the same way as the horizontal-axis wheels.

FIG. 14 illustrates a grinding unit equipped with two cup wheels 1 driven by motor 4 and mounted in a suitable bracket 35, which is guided by means of a parallel motion assembly with arms 36 and 37 that are pivoted on the frame 7 supported by bearing shoes 8 and 8' on the rail. The upper suspension arm 36 bears or is pivoted on the hydraulic stop means **14*a* that forms the upper part of a twin cylinder 28, the lower part thereof has the function of the hydraulic grinding cylinder 12*a* for adjusting the vertical stroke of the grinding wheels 1. The stop means 14*a* carries a sensor 17** and is controlled by means of a regulator as described hereinabove to take up the wheel wear.

FIG. 15 illustrates a truck comprising a chassis 38 equipped with wheels for rolling on the track and with grinding units for each rail of the track. There are four grinding units, namely two units each comprising a frame 32 carrying a pair of workheads with their hydraulic grinding cylinders 12, and two units each comprising a frame 33 carrying one inclined workhead with its grinding cylinder 12 for re-shaping the inner portion of the rail. All the frames 32,33 are equipped with shoes 8 bearing on the rail and are suspended from the chassis 38 by pneumatic cylinders 31 adapted to relieve the grinding units and to raise them under light-running conditions. As described hereinabove each workhead is connected to a rocker 13, the end position thereof is defined by the adjustable stop means 14.

Figure 16:
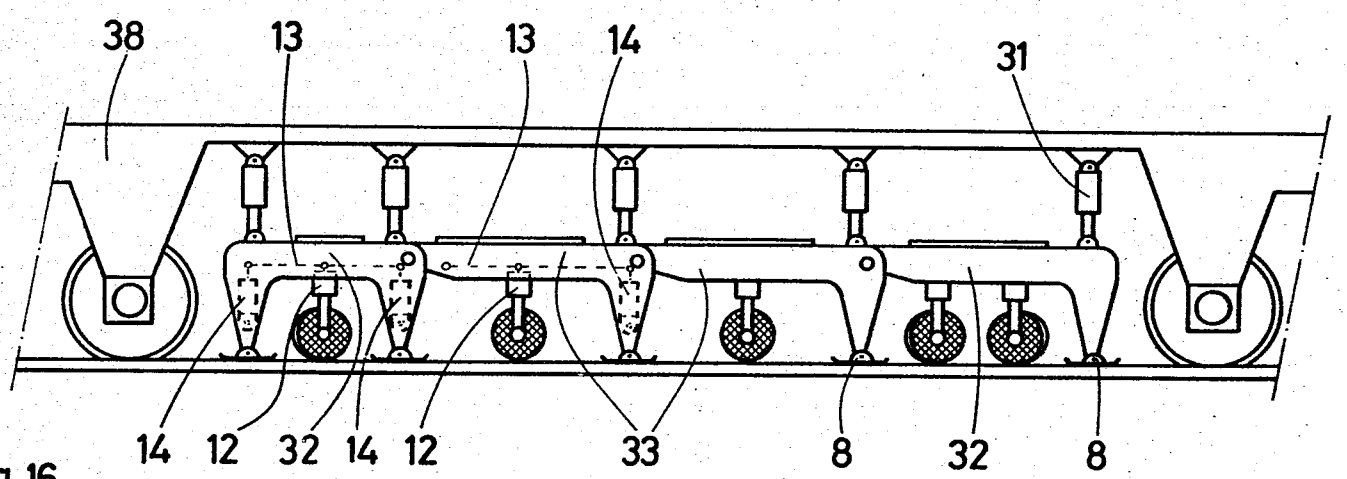
FIG. 16 is an elevational view similar to FIG. 15 but showing a modification.

With the railroad rail grinding truck of this invention, an assembly comprising a plurality of such trucks may be coupled to one another to constitute a complete grinding train. Each truck may comprise different grinding units, for example: units having different grinding-base lengths as shown in FIG. 16, units having symmetrical or asymmetrical bases; units having multiple vertical or inclined heads; units having single or multiple heads with cup grinding wheels, etc.

Although specific forms of embodiment of this invention have been described hereinabove and illustrated in the accompanying drawing, it will readily occur to those skilled in the art that various other modifications and changes of the truck and of the grinding units or workheads may be brought thereto without departing from the scope of the invention as set forth in the appended claims.

What is claimed is:

1. A track grinding truck for grinding the tread surface of a railroad rail, which comprises at least one grinding unit comprising spaced shoes bearing on said rail, grinding means comprising at least one grinding wheel, means for driving said grinding means, means including a fluid-actuated cylinder for supporting said grinding means between said shoes in position to grind the tread surface of said rail, adjustable stop means independent of said cylinder for variably limiting movement of said grinding means toward said rail by said cylinder, and servo-action regulating means controlling said stop means as a function of the degree of wear of said grinding means and also of the undulation of said rail surface so that the point of contact between said grinding means and said rail cannot fall below a grinding base defined by a straight line connecting points of contact of said shoes with said rail.

2. A track grinding truck according to claim 1, wherein said regulating means is responsive to the power consumption of said grinding means driving means and to the distance covered on the track.

3. A track grinding truck according to claim 1, wherein said regulating means is responsive to the vertical movement of said grinding means and to the distance covered on the track.

4. A track grinding truck according to claim 1, wherein said means for supporting said grinding means comprises a frame mounting said shoes and a rocker having one end pivotally connected with said frame, said grinding means being supported by said cylinder from an intermediate portion of said rocker, and wherein said adjustable stop means comprises means for positioning the opposite end of said rocker.

5. A track grinding truck according to claim 4, wherein said adjustable stop means comprises a hydraulic unit acting between said opposite end of said rocker and said frame.

6. A track grinding truck according to claim 4, wherein said adjustable stop means comprises a mechanical adjusting unit acting between said opposite end of said rocker and said frame.

7. A track grinding truck according to claim 1, wherein said means for supporting said grinding means comprises a pivoted member supporting said grinding means, said fluid-actuated cylinder acting on said pivoted member to move said grinding unit toward said rail and said adjustable stop means acting on said pivoted member to limit movement of said grinding means toward said rail.

8. A track grinding truck according to claim 7, wherein said adjustable stop means comprises a hydraulic unit.

9. A track grinding truck according to claim 8, wherein said hydraulic unit comprises a hydraulic cylinder coaxial with said fluid-actuated cylinder.

10. A track grinding truck according to claim 9, wherein said pivoted member is pivotally connected with one of said shoes and said hydraulic cylinder and said fluid-actuated cylinder act between said pivoted member and the other of said shoes.

11. A track grinding truck according to claim 1, wherein said grinding means comprises at least two separately adjustable grinding wheels.

12. A track grinding truck according to claim 1, wherein said grinding means comprises a grinding wheel positioned asymmetrically with respect to said grinding base.

13. A track grinding truck according to claim 1, comprising a plurality of said grinding units pivotally connected in tandum with one another, an endmost one of said units having two of said shoes supporting said unit, and the other units being supported by one shoe and by pivotal connection to an adjacent unit.

14. A track grinding truck according to claim 13, wherein the spacing between said shoes are of different lengths, whereby undulation in the tread surface of said rail still existing after the passage of one grinding unit can be ground by a succeeding unit or succeeding units.

15. A track grinding truck according to claim 13, wherein each of said grinding units other than said endmost unit comprises an L-shaped frame having a downwardly extending leg portion pivotally connected with one of said shoes and a generally horizontal arm pivotally connected with the frame of the next adjacent unit, said grinding means being supported by said arm.

* * * * *